United States Patent [19]

Krasuski et al.

[11] Patent Number: 4,932,188

[45] Date of Patent: Jun. 12, 1990

[54] APPARATUS FOR CLOSING ENVELOPES

[75] Inventors: Marek Krasuski, Fontenay aux Roses; Bernard Prugnolle, Pantin, both of France

[73] Assignee: Societe Anonyme dite: Alcatel Satmam, Bagneux, France

[21] Appl. No.: 380,361

[22] Filed: Jul. 17, 1989

[30] Foreign Application Priority Data

Jul. 27, 1988 [FR] France ..... 88 10117

[51] Int. Cl.[5] ..... B65B 7/02

[52] U.S. Cl. ..... 53/64; 53/266 A; 53/383; 53/391; 493/245

[58] Field of Search ..... 53/266 A, 206, 460, 53/381 R, 64, 69, 376, 377, 391, 390, 467, 480, 482, 569; 493/245, 453

[56] References Cited

U.S. PATENT DOCUMENTS 2,749,689 6/1956 Colley .
3,550,351 12/1970 Gombault ..... 493/245 X
3,936,993 2/1976 Dorer ..... 53/376 X
4,270,909 6/1981 Ireland ..... 493/245
4,428,794 1/1984 Hayskar et al. ..... 53/383 X
4,619,101 10/1986 Havey, Jr. et al. ..... 53/266 A X

FOREIGN PATENT DOCUMENTS 0153162 8/1985 European Pat. Off. .

*Primary Examiner*—James F. Coan
*Attorney, Agent, or Firm*—Sughrue, Mion, Zinn, Macpeak & Seas

[57] ABSTRACT

The apparatus for closing envelopes includes two sets of drive wheels (11A, 11B; 12A, 12B) defining a substantially linear envelope path (1) along which envelopes which are received open are displaced flat, are closed, and are then ejected. The apparatus includes a pair of pivotally mounted presser elements (30, 31) disposed between the two sets of drive wheels and put in a rest position off the path while the envelope is advancing and moved to a working position on the path when an open flap reaches the pair of presser elements, with the direction of displacement of the envelope along the path then being reversed substantially simultaneously with the pair of elements being put into the working position. The invention is applicable to processing mail.

9 Claims, 2 Drawing Sheets

APPARATUS FOR CLOSING ENVELOPES

The present invention relates to installations for processing mail automatically. It relates in particular to apparatus for use in such installations to close envelopes that have previously been filled.

BACKGROUND OF THE INVENTION

Such an apparatus for closing filled envelopes may be integrated in an insertion machine, or else it may merely be coupled to the outlet from an insertion machine. In the insertion machine, envelopes are presented opened to a filling station which also receives folded documents for insertion into the envelopes. After they have been filled, the envelopes are evacuated from the filling station while still open. The apparatus which closes them may be used in turn for directly feeding a "franking" or postage machine, or it may deliver them to a storage magazine.

In conventional manner, apparatuses for closing envelopes receive the envelopes which are presented thereto separately from one another and with their flaps open. The apparatuses moisten the gum on the flaps, and then fold the flaps towards the corresponding envelope bodies in order to close the envelopes. French certificate of utility number 219532 describes such prior art apparatus.

In the embodiment described in that document, the envelopes to be closed are received on a platform, with the envelope bodies resting on and driven by the platform, while their flaps project beyond the platform and hang down freely. While each envelope is being displaced on the platform, a deflector guides the flap between a moistening member and an associated backing pressure member, both mounted beneath the platform. This moistening member is a wick dipping in a supply of water. The backing pressure member folds and firmly presses the gummed region of the flap against the wick in order to moisten the gummed region by wiping it over the wick.

This backing pressure member extends beyond the moistening member or is associated with another deflector in order to continue folding the flap and to guide it through an opening provided in the platform. Beyond this opening, a backing pressure plate seals the flap against the body of the envelope.

These parts for suitably guiding the flap and pressing its gummed region firmly against the wick are complex in shape, and they are inconvenient and expensive to make. In addition, they give rise to an apparatus for closing envelopes which is relatively voluminous.

The object of the present invention is to provide apparatus for closing envelopes which avoids the above drawbacks and which operates reliably.

SUMMARY OF THE INVENTION

The present invention provides an apparatus for closing envelopes, the apparatus comprising a substantially linear path receiving open envelopes at an inlet and delivering closed envelopes at an outlet, envelope drive means on the path, and an assembly for folding the flap and closing envelopes as the envelopes move along the path, wherein said assembly for folding the flap and closing the envelopes comprises a pair of presser elements pivotally mounted relative to said path to pivot between a rest position in which said pair lies off the path, and a working position in which said pair lies across the path with said presser elements being on opposite sides of said path, wherein said drive means are coupled to a reversible motor, and wherein the apparatus further includes means for detecting the position of each envelope along the path, said means being coupled to said motor and to said pair of presser elements to control them, and successively ensuring that the pair of presser rollers is held in its rest position while the envelope is moving in a "forwards" direction along the path from the inlet towards the pair of presser elements, and putting the pair of presser elements into the working position when the flap of the envelope is present level therewith, and substantially simultaneously reversing the direction of displacement of the envelope along said path in order to reverse it along said path.

In this apparatus of the invention, putting the pair of presser elements into the working position folds the flap of the envelope substantially through 90°, thereby positioning the flap in front of said pair of presser elements, and the withdrawal of the envelope along the path between the pair of presser elements causes the flap to be folded down completely onto the body of the envelope, thereby closing the envelope.

BRIEF DESCRIPTION OF THE DRAWINGS

An embodiment of the invention is described by way of example with reference to the accompanying drawings, in which.

DETAILED DESCRIPTION

Figure 1:
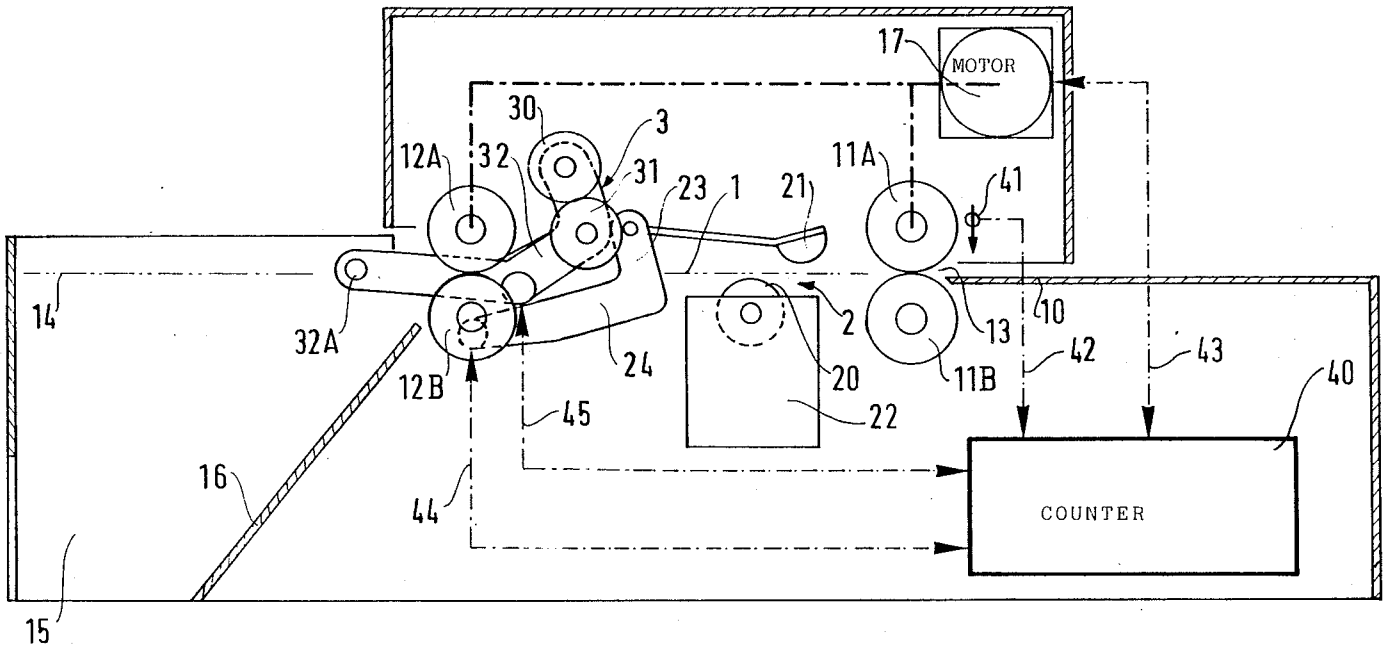
FIG. 1 is a diagram showing the apparatus of the invention for closing envelopes.

As shown in FIG. 1, the apparatus of the invention comprises a substantially linear envelope path 1 represented by a dot-dashed line, with envelopes being closed as they move therealong. This envelope path 1 is defined by a platform 10, a first set of wheels 11A, 11B interposed on the platform, and a second set of wheels 12A, 12B beyond the platform. The two sets of wheels 11A & 11B and 12A & 12B constitute means for driving the envelopes along the path 1.

Successive envelopes are presented open at an inlet 13 to the path defined at the first set of wheels 11A, 11B, with the envelopes being delivered closed at an outlet 14 opposite to the inlet 13 and defined beyond the second set of wheels 12A, 12B. The outlet 14 is not constituted by physical components on the path 1, it is constituted merely by a distance from the second set of wheels 12A, 12B which is greater than the height of the closed envelopes so that once the envelopes are no longer engaged between the wheels 12A and 12B they fall into a reception compartment or magazine 15 provided for that purpose beneath the path. A sloping deflector 16, optionally forming a part of the reception compartment 16 serves to guide closed envelopes as they fall and to separate the reception compartment from the mechanisms of the apparatus.

The open envelopes presented to the inlet 13 of the path lie flat on the path and arrive body first. The gummed face of each open envelope flap lies behind the envelope body and faces towards the path 1.

The way in which envelopes are brought to the inlet 13 of the path is independent from the way in which the envelopes are closed by the apparatus of the invention. Means for feeding the apparatus with envelopes are therefore neither shown nor described. It is merely mentioned that the inlet 13 may be fitted with an envelope-filling station in which case the filling station receives empty open envelopes from a magazine, or else the inlet 13, may merely receive previously filled envelopes which are presented to it in the open condition.

A motor 17 drives the envelopes along the path 1. The motor is controlled to be driven in one direction of rotation or the other. It is coupled to wheels 11A and 12A which are situated above the path 1. The motor is a stepper motor or a D.C. motor for driving each envelope along the path in either direction. It includes means for specifying the position of each envelope at any desired by counting steps, either the steps of the motor itself, or else the steps of an associated encoder.

Although not shown, it is advantageous for the two other wheels 11B and 12B associated with the drive wheels 11A and 12A to be mounted so as to be capable of retracting a little beneath the path 1, while being individually controlled to bear against the corresponding drive wheel 11A or 12A. Such an arrangement makes it possible to fit the inlet 13 to the path 1 with an envelope-filling station, if so desired.

On the path 1, and between the two sets of wheels 11A & 11B and 12A & 12B, the apparatus for closing envelopes comprises a moistening assembly 2, and an assembly 3 for folding envelope flaps and closing envelopes.

The moistening assembly 2 includes a moistening element 20 mounted beneath the path 1 and an associated moistening deflector 21 mounted above the path 1. The moistening element 20 is shown as being constituted by a moistening roller having a horizontal axis. A portion of this roller dips in water in a supply tank 22. The periphery of the roller remains slightly below the path 1.

The moistening deflector 21 is semicylindrical in shape. It is carried at the end of a support 23 which is hinged at its opposite end about an axis 23A and its pivoting is controlled by a lever 24 for actuating the support. The moistening deflector can thus pivot facing the path 1 and the moistening roller 20 between a retracted position above the path which constitutes its rest position as shown in FIG. 1, and a position where it constitutes an obstacle across the path 1, which constitutes its moistening position (not shown in Figure 1). When in the moistening position, the moistening deflector 21 crosses the path between the moistening roller 20 and the set of wheels 11A, 11B. It crosses the path a short distance upstream from the moistening roller without making contact therewith, but with the low point of its periphery being lower than the top level of the moistening roller 20. It is shown in this moistening position in the diagram of FIG. 2B.

Figure 2:
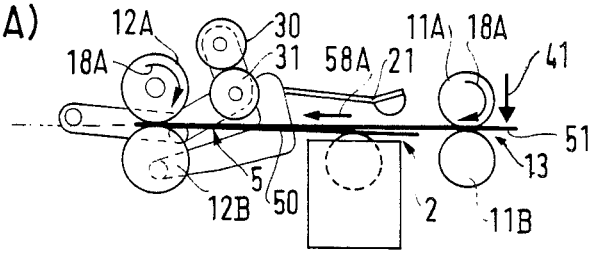
FIG. 2A–2E show successive stages in the operation of the apparatus.
Figure 2:
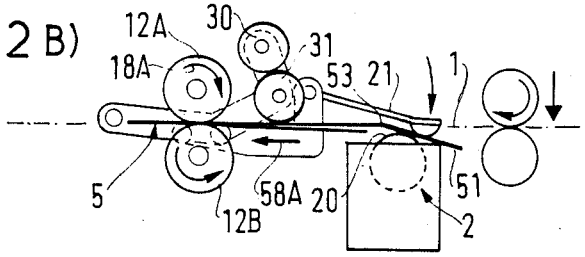
Figure 2:
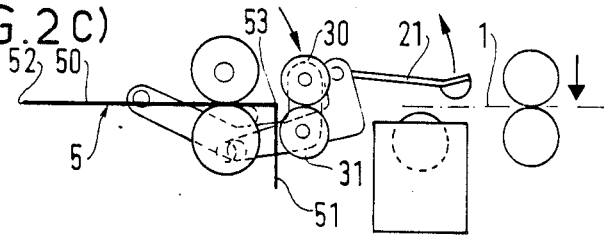
Figure 2:
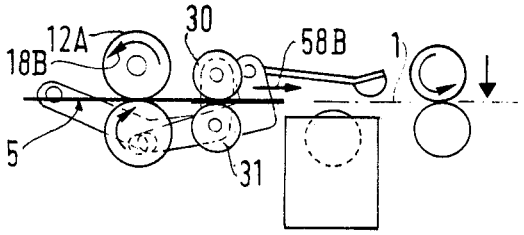
Figure 2:
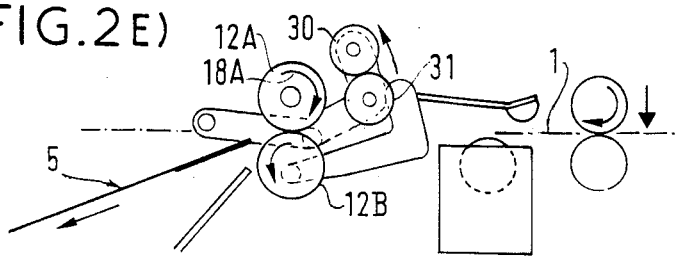

The assembly 3 for folding the flap and closing the envelopes is mounted between the moistening assembly 2 and the second set of wheels 12A, 12B. It comprises a pair of presser elements 20 and 31 comprising two rollers which are kept pressed resiliently against each other. These presser rollers are mounted on the terminal portions of a pair substantially L-shaped arms. The other terminal portions of the pairs of arms are hinged about an axis 32A. The arms controlled in position about this axis to cause the pair of presser rollers 30, 31 to pivot between a rest position and a working position facing the path 1. When in the rest position, the pair of presser rollers 30, 31 lies completely off the path; as shown in FIG. 1, the two rollers are then pressed against each other, one above the other and both above the path 1. In contrast, in the working position, the pair of presser rollers lies on the path 1, and as can be seen in the diagrams of FIGS. 2C and 2D the rollers pressing against each other are on opposite sides of the path, with the bottom roller being beneath the path and flush therewith, while the top roller then occupies the position which the bottom roller occupies when at rest.

In this assembly 3, moving the pair of presser rollers from its rest position to its working position serves to fold the flap to substantially 90° relative to the envelope body, and keeping the pair of rollers in the working position serves to close each envelope in a manner described below.

The apparatus for closing envelopes also includes means for detecting the position of each envelope on the path 1. These means comprise a counter 40 triggered to begin counting by an envelope detector cell 41 and coupled to the control of the motor 17 for counting its rotary steps, or else coupled to count pulses from a coder associated with the motor. The envelope detection cell 41 is mounted substantially level with the inlet 13 to the path or else between the inlet 13 and the moistening assembly 2. It preferably triggers motor step counting when the leading foot of an incoming envelope is level therewith, however it would also be possible to trigger counting from the instant that a facing envelope leaves the cell. The counter 40 counts the rotary steps of the motor 17 without taking account of its direction of rotation. Changes in state of the counter represent the distance travelled by each envelope along the path 1 since the beginning of counting. By counting motor steps in this way, it is easy to detect the positions of envelopes along the path, regardless of the format of the envelopes.

During the closure cycle for each envelope, the counter 40 defines the successive control stages of the apparatus. It is used for controlling the motor 17 itself, in particular for reversing its direction of rotation, and also for controlling the moistening deflector 21 and the presser rollers 30 and 31.

A connection 42 between the counter 40 and the cell 41 conveys the start-of-counting command delivered by the cell. A connection 43 drawn in dot-dashed lines between the counter 40 and the motor 17 represents the coupling therebetween firstly for counting motor steps and secondly for stopping the motor if necessary and for reversing its direction of rotation. A connection 44 shown in dot-dashed lines between the counter 40 and the lever 24 for actuating the support 23 of the moistening deflector 21 represents the coupling therebetween for putting the deflector into the moistening position, and for holding it there. Another connection 45 also drawn in dot-dashed lines between the counter 40 and the pair of arms 32 supporting the presser rollers 30 and 31 represents coupling therebetween for putting the pair of presser rollers into the working position and for holding the rollers there. These commands correspond to particular defined values of the state of the counter 40, which values correspond to particular positions for each envelope along the path 1.

Above-mentioned connections 44 and 45 represent control means (not shown) constituted by individual electromagnets or, in a variant, by individual cams mounted on a common drive shaft and rotated through a complete turn by an auxiliary motor. If an auxiliary motor is used, it is preferably a stepper motor and its rotation (which takes place continuously in the same direction) is controlled step by step from the beginning of counting. The auxiliary motor is stopped by detecting a reference or "zero" position on the cam shaft.

In a variant, the position of each envelope on the path may be detected by a series of cells analogous to the cell 41 and delivering appropriate control signals on the links 43 to 45 by means of a logic circuit.

The successive stages a closure for an envelope are illustrated in the diagrams FIGS. 2A to 2E in which the components of the apparatus are designated by the same references as before and an envelope is given an overall reference 5, with its body being referenced 50, its flap 51, its foot 52, and its join or fold line between the flap and the body being referenced 53. These references 50 to 53 are not marked in all of the diagrams in order to avoid overcrowding them.

Diagram 2A shows the stage during which the envelope 5 moves forwards or advances along the path 1 from the inlet 13 at which it was presented earlier and detected by the cell 41. The wheels 11A and 12A are driven in the direction of arrows 18A and advance the envelope along the path along arrow 58A. As it advances, the body 50 of the envelope passes footforemost through the moistening assembly 2 whose deflector is then in the rest position, and through the folding and closing assembly whose presser rollers 30 and 31 are also in their rest position, and then continues between the wheels 12A and 12B. The flap 51 of the envelope still held between the wheels 11A and 11B is about to leave them. As the envelope advances, the cell 41 serves to detect successive positions of the envelope along the path to trigger the successive stages for controlling the cycle.

Diagram 2B shows the control stage during which the flap 51 is moistened, which takes place when the envelope is detected as being in its "moistening" position a shown, i.e. when its flap enters the moistening assembly 2. In this moistening position of the envelope, the moistening deflector is actuated into its moistening position, and envelope advance may optionally be halted. The moistening deflector bears against the non-gummed base of the flap 51 which it folds slightly at the fold line 53 while pressing the gummed face against the moistening roller 20. Moistening takes place as the envelope advances in the direction of above-mentioned arrow 58A.

Diagram 2C shows the control stage during which the flap 51 is folded, which takes place when the envelope is detected as being in its "folding" position. When in the folding position, the already-moistened flap has left the moistening assembly and is facing the presser rollers 30 and 31 with its fold line 53 immediately downstream therefrom. In this folding position the moistening deflector 21 returns to its rest position, the wheels 11A and 12A are no longer driven, thereby stopping envelope advance, while the pair of presser rollers 30 and 31 is actuated to take up its working position, as shown. During this actuation, the bottom roller 31 of the pair of presser rollers bears against the non-gummed and non-moistened face of the flap 51, thereby performing initial folding of the flap. The flap slides over the periphery of the roller 31 and folds through 90° about its fold line 53 so as to extend substantially vertically beneath the path, immediately downstream from the presser rollers 30 and 31. A time delay defined a pause for the envelope in its folding position while the pair of presser rollers is moving into its working position, after which the closure stage begins.

Diagram 2D illustrates the closure stage. The wheels 11A and 12A are now driven in the opposite direction as shown by arrow 18B, thereby reversing the envelope along the path in the direction of arrow 58B.

This reversing of the envelope completes the folding of the flap against the body of the envelope by passing the envelope fold line 53 first between the presser rollers 30 and 31 in order to close it. The end of this stage is determined by detecting that the envelope has reversed far enough to be closed. There follows an ejection stage for the closed envelope.

Diagram 2E illustrates this closed envelope ejection stage which runs from detecting the envelope in its "flap closed" position, thereby reversing the direction of rotation of the wheels 11A and 12A a second time. These wheels are then driven in the direction of arrow 18A causing the now-closed envelope to move forwards again along the path. As it advances again, the closed envelope moves between the wheels 12A and 12B. The flap closed against the body passes back between the presser rollers, and after leaving them it passes between the wheels 12A and 12B. On leaving the wheels 12A and 12B, the closed envelope falls from the path 1 into the reception compartment, while the pair of presser rollers 31 returns to the rest position.

In a variant (not shown) the ejection stage may extend the closure stage shown in diagram 2D directly, with the wheels 11A and 12A continuing to be driven in the direction of arrow 18B so that the envelope passes right back along the path towards the inlet 13. Under such conditions, the reversing of the envelope along the path which served to close the envelope is then maintained and the closed envelope outlet is no longer provided opposite from the inlet 13 along the path 1, but is provided at the same end as the inlet 13. By continuing to reverse the closed envelope, it passes back through the moistening assembly 2 whose moistening deflector is then in its rest position so as to avoid having any affect on the reversing envelope, after which the envelope passes between the wheels 11A and 11B. When the envelope leaves the wheels 11A and 11B, it leaves the path to fall into a reception compartment analogous to that mentioned above and the pair of presser rollers returns to the rest position. Advantageously, in this variant, each envelope to be closed is presented to the inlet 13 of the path along a sloping trajectory defined above the path 1 opening out at an angle onto the path between the wheels 11A and 11B.

The main advantage of the closure apparatus of the invention lies in the simplicity of its design and implementation, and in its compactness. It gives rise to robust equipment of relatively low cost.

In a variant, not shown, the pair of presser elements comprise the top roller 30 and a bottom elongate section bar replacing the bottom roller 31 as described above. The section bar is shaped so as to extend the length of the contact zone between the pair of presser elements, i.e. it includes a concave portion extending round an arc of the top roller 31, thereby lengthening the effective length along the envelope over which the presser elements operate. This widens the range of envelope flap lengths with which the apparatus can be used.

We claim:

1. Apparatus for closing envelopes, the apparatus comprising a substantially linear path receiving open envelopes at an inlet and delivering closed envelopes at an outlet, envelope drive means on the path, and an assembly for folding the flap and closing envelopes as the envelopes move along the path, wherein said assembly for folding the flap and closing the envelopes comprises a pair of presser elements pivotally mounted relative to said path to pivot between a rest position in which said pair lies off the path, and a working position in which said pair lies across the path with said presser elements being on opposite sides of said path, wherein said drive means are coupled to a reversible motor, and wherein the apparatus further includes means for detecting the position of each envelope along the path, said means being coupled to said motor and to said pair of presser elements to control them, and successively ensuring that the pair of presser rollers is held in its rest position while the envelope is moving in a "forwards" direction along the path from the inlet towards the pair of presser elements, and putting the pair of presser elements into the working position when the flap of the envelope is present level therewith, and substantially simultaneously reversing the direction of displacement of the envelope along said path in order to reverse it along said path.

2. Apparatus for closing envelopes according to claim 1, and including a flap moistening assembly having a moistening element and an associated moistening deflector, wherein said moistening assembly is mounted between the inlet and the pair of pressure elements, with said positioning elements being on one side of the path and lying substantially flush with the path, and with said moistening deflector pivoting on the other side of the path between a rest position where it lies off the path and an obstacle position where it lies across the path, said moistening deflector being coupled to said means for detecting the position of each envelope to cause it to move into its obstacle position when the flap of the envelope is present level therewith as the envelope moves forwards along the path.

3. Apparatus for closing envelopes according to claim 1, wherein said inlet and said outlet are at opposite ends of said path, and wherein said means for detecting the position of each envelope are coupled to said reversible motor for the purpose of displacing the envelope along the path in the forwards direction for ejection purposes while the pair of presser elements is held in the working position and after the envelope has reversed at least partially between said presser elements.

4. Apparatus for closing envelopes according to claim 1, wherein said drive means comprise at least two sets of wheels pressing against each other and defining said path along which each envelope is displaced flat, foot-first as it moves forwards.

5. Apparatus for closing envelopes according to claim 2, wherein said means for detecting the position of each envelope comprise an envelope detection cell mounted between the inlet of the path and the moistening assembly, and a counter coupled to said cell for the purpose of triggering counting, and to said reversible motor to count unit displacements referred to as "steps" of each envelope along the path, without taking account of the direction of the unit displacements.

6. Apparatus for closing envelopes according to claim 5, wherein said reversible motor is a stepper motor.

7. Apparatus for closing envelopes according to claim 5, wherein said reversible motor is a D.C. motor.

8. Apparatus for closing envelopes according to claim 3, wherein each pair of presser elements comprises a pair of rollers resiliently mounted to press against each other on a pair of arms.

9. Apparatus for closing envelopes according to claim 3, wherein said pair of presser elements comprises a roller and an elongate section member resiliently mounted to press against each other on a pair of arms.

* * * * *